United States Patent [19]

McElroy

[11] 4,301,438

[45] Nov. 17, 1981

[54] ADJUSTABLE FORCE PRODUCING MEANS FOR MANUALLY MOVABLE CONTROL LEVERS IN A SPACE THERMOSTAT

[75] Inventor: Jerry W. McElroy, St. Louis, Mo.

[73] Assignee: Emerson Electric Co., St. Louis, Mo.

[21] Appl. No.: 93,793

[22] Filed: Nov. 13, 1979

[51] Int. Cl.[3] ..... H01H 37/12

[52] U.S. Cl. ..... 337/339; 337/360; 411/147

[58] Field of Search ..... 337/115, 303, 334, 337–339, 337/360, 374; 236/47; 151/38; 85/82, 1 JP

[56] References Cited

U.S. PATENT DOCUMENTS

| | | | |
|---|---|---|---|
| 952,507 | 3/1910 | Burns | 85/1 JP |
| 2,596,657 | 5/1952 | Crum | 337/339 |
| 2,761,349 | 9/1956 | Heller | 151/38 |
| 2,928,445 | 3/1960 | Van Buren | 151/38 |
| 3,807,254 | 4/1974 | Brakebill | 337/360 |

*Primary Examiner*—William H. Beha, Jr.
*Attorney, Agent, or Firm*—Paul A. Becker, Sr.

[57] ABSTRACT

In a space thermostat having a control lever for setting the temperature set-point, a force producing means clamps the control lever to the thermostat casing through an elongated slot in the casing. A hollow, rigid thin-walled nut, a compressible anchor ring, and a screw cooperate to provide means for adjusting the value of the clamping force to a value which enables manual movement of the control lever, upon application thereto of a desired force, to a different temperature set-point. The clamping force is further adjustable to a value which prevents manual movement of the control lever when it is desired to provide a locked condition wherein the control lever cannot be manually moved.

1 Claim, 6 Drawing Figures

ADJUSTABLE FORCE PRODUCING MEANS FOR MANUALLY MOVABLE CONTROL LEVERS IN A SPACE THERMOSTAT

This invention relates to space thermostats employing manually movable temperature set-point control levers, and particularly to construction of force producing means which determine the force required to manually move the control levers.

In so-called night set-back thermostats, one prior art construction employs a first control lever to set the daytime temperature set-point and a second control lever to set the nighttime set-point. The levers are independently adjustable so that either or both of the temperature set-points may be changed to a higher or lower value as desired. Each control lever is attached to a temperature responsive switch means and the two switch means are co-axially mounted on and pivoted about a single pin extending from the thermostat casing.

Such co-axial mounting is desirable in that it enables a compact package and reduces the number of parts. A problem exists, however, when employing this co-axial mounting, in providing the proper force on the control levers so as to allow manual movement of one control lever without causing other lever to also move.

While a prior art clutch-type construction utilizing various flat and wave washers on the pin on which the switch means are mounted usually provides an acceptable force, such construction is generally unacceptable in that the value of the force is dependent solely upon parts tolerances and cannot be adjusted to compensate for parts out of tolerance. Such construction therefore results in a wider range of force values than is desired, and in an excessive amount of re-working of thermostats whose force values are either too low or too high.

An object of the present invention is to provide a generally new and improved force producing means on a temperature set-point control lever in a space thermostat.

A further object is to provide a generally new and improved force producing means on each temperature set-point control lever in a space thermostat, the space thermostat having two co-axially mounted temperature responsive switch means wherein each switch means is independently controlled by its own manually movable temperature set-point control lever.

A further object is to provide such a force producing means of the preceding paragraphs which is adjustable to provide a desired force to both ensure stability of the control lever when in a temperature set-point position and to facilitate manual movement of the control lever from one temperature set-point to another.

Yet a further object is to provide such force producing means of the preceding paragraph which is further adjustable to provide a locked condition wherein manual movement of the control lever is prevented.

Other objects and advantages of the present invention will become apparent from the following description when read in connection with the accompanying drawings.

DESCRIPTION OF THE PREFERRED EMBODIMENT

While a space thermostat having two temperature set-point control levers is illustrated and described in the following specification, it is to be understood that the force producing means of this invention is also applicable to a space thermostat having only one control lever.

Figure 1:
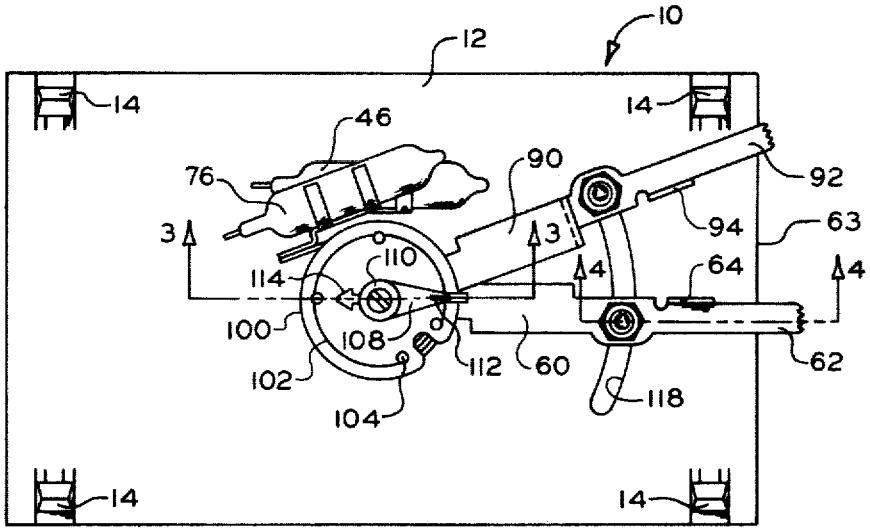
FIG. 1 is a top plan view of a space thermostat incorporating the force producing means of the present invention, shown with the cover removed.

Referring to FIG. 1, a space thermostat for controlling the temperature in a conditioned space at two different levels of temperature is indicated generally at 10. For the sake of brevity, not shown are various electrical components, such as electrical timer motors, wiring connections, and sub-base switching devices, which may be employed in thermostat 10 but are not considered essential to a description of the present invention.

Figure 3:
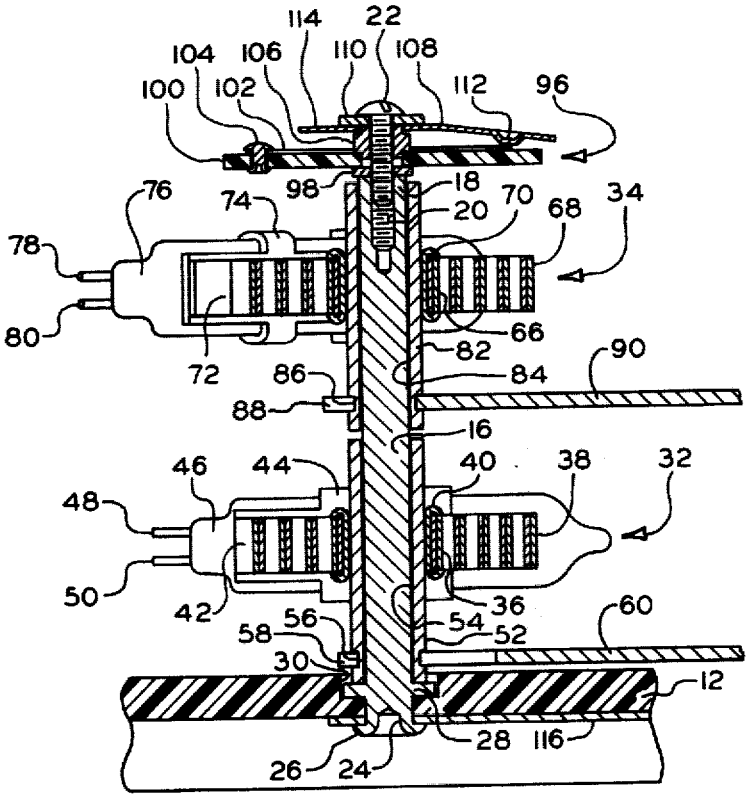
FIG. 3 is an enlarged cross-sectional view taken along line 3—3 of FIG. 1.

Thermostat 10 comprises a casing 12 having four upwardly extending posts 14 for receiving a cover (not shown) in a snap-on manner. As shown in FIG. 3, a pin 16 is firmly attached perpendicular to casing 12. One end 18 of pin 16 is bored and threaded at 20 to receive a screw 22 while the other end 24 is coined at 26. An enlarged diameter portion 28 of pin 16 is spaced from coined end 24 and is nested in a circular cavity 30 of casing 12 to ensure that pin 16 is firmly attached to casing 12 and is perpendicular thereto.

Figure 2:
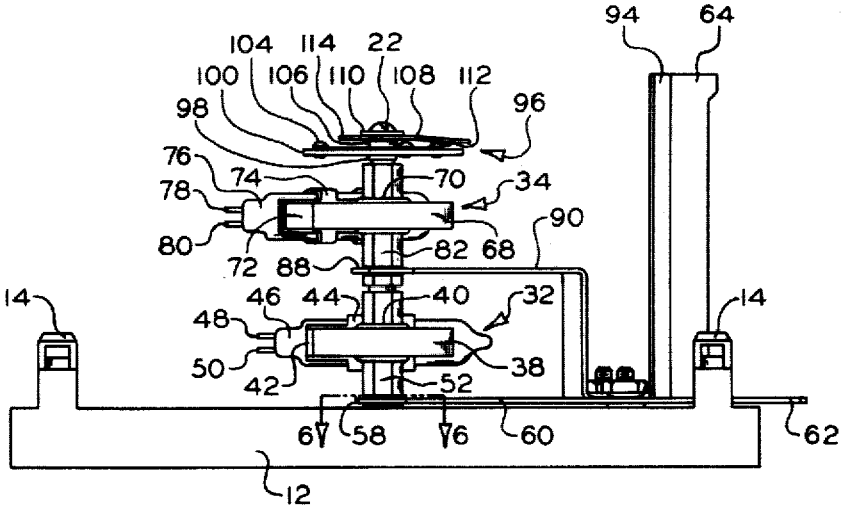
FIG. 2 is a front elevation view of the thermostat of FIG. 1.

Mounted co-axially on pin 16 are two temperature responsive switch means indicated generally at 32 and 34 in FIGS. 2 and 3. In switch means 32, one end 36 of a spirally-wound bimetallic coil 38 is rigidly attached to a cylindrical sleeve 40, as shown in FIG. 3, by coining sleeve 40 over coil end 36. A free end 42 of coil 38 is attached, as by spot welding, to a metal clip 44 in which a mercury type switch 46 is secured. Mercury type switch 46 is a conventional switch comprising conductive electrodes 48 and 50 which extend outside switch 46 for connection to electrical leads (not shown), and which extend inside switch 46 where they are adapted to be connected by a blob of mercury (not shown) when switch 46 is rotated about pin 16 sufficiently in one direction and to be disconnected when rotated sufficiently in the opposite direction.

Figure 6:
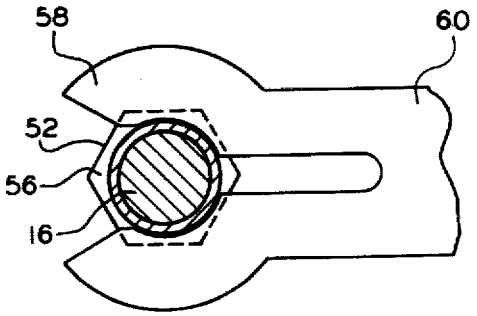
FIG. 6 is an enlarged cross-sectional view taken along line 6—6 of FIG. 2.

Sleeve 40 is secured by a press fit to an elongated, hexagonal bushing 52. Bushing 52 has an inner circular through bore 54 having a diameter slightly greater than the diameter of pin 16. As shown more clearly in FIG. 6, bushing 52 includes a circular undercut 56 near one end thereof for accepting, in a snap-on manner, a bifurcated end 58 of a temperature set-point control lever 60.

As shown in FIGS. 1 and 2, control lever 60 extends radially outwardly from bushing 52. The radially outermost end 62 of control lever 60 extends slightly beyond a peripheral edge 63 of casing 12 for facilitating convenient manual movement of control lever 60 to set the desired temperature set-point, i.e., the temperature at which switch 46, depending on the type of space conditioning apparatus being controlled thereby, is to be effective to either connect or disconnect electrodes 48 and 50. Control lever 60 also includes an elongated tab 64 extending upwardly, as viewed in FIG. 2. Tab 64 is visible through an opening in the cover (not shown) and cooperates with a graduated temperature scale on the cover so as to indicate the temperature set-point value to which control lever 60 is set.

Switch means 34 is constructed in a manner similar to switch means 32 and, as shown in FIG. 3, is mounted on pin 16 above switch means 32. In switch means 34, one end 66 of a spirally-wound bimetallic coil 68 is rigidly attached to a cylindrical sleeve 70. A free end 72 of coil 68 is attached to a metal clip 74 which carries a mercury type switch 76 having conductive electrodes 78 and 80.

Sleeve 70 is pressed on to an elongated, hexagonal bushing 82 having an inner circular through bore 84. As with inner bore 54 of bushing 52, the diameter of inner bore 84 of bushing 82 is slightly greater than the diameter of pin 16. Bushing 82 includes a circular undercut 86 near one end thereof for accepting, in a snap-on manner, a biforcated end 88 of a temperature set-point control lever 90.

As shown in FIGS. 1 and 2, control lever 90 extends radially outwardly from bushing 82. The radially outermost end 92 of control lever 90 extends slightly beyond peripheral edge 63 of casing 12 for facilitating convenient manual movement of control lever 90 to set the desired temperature set-point for switch means 34. Two 90-degree bends in lever 90, between its biforcated end 88 and its radially outermost end 92, results in its radially outermost end 92 and the radially outermost end 62 of control lever 60 being in the same plane. Control lever 90 includes an elongated tab 94 extending upwardly, as viewed in FIG. 2. Tab 94 is visible through the same opening in the cover previously described and, in cooperation with the same graduated temperature scale previously described in connection with tab 64 of control lever 60, indicates the temperature set-point value to which control lever 90 is set.

When thermostat 10 controls heat producing apparatus, it is desirable to provide anticipation means for maintaining a more constant temperature in the space being heated. This anticipation means may be provided in a variety of well-known constructions, such as an adjustable-resistor type indicated generally at 96 in FIGS. 1, 2, and 3. It should be noted that the details of construction of anticipation means 96 form no part of this invention and are briefly described herein only to illustrate that a heating anticipator, when utilized, is preferrably mounted on the same pin 16 on which switch means 32 and 34 are mounted.

In FIG. 3, anticipation means 96 is secured by screw 22 to pin 16 and includes a washer 98, an insulative disc 100 to which a fine wire 102 is secured by four rivets 104, a symmetrically-stepped, electrically-conductive sleeve 106, an electrically-conductive arm 108 mounted for rotation about sleeve 106, and an electrically-conductive washer 110. One end 112 of arm 108 is biased into contact with wire 102, and the other end 114 of arm 108 cooperates with indicia (not shown) on disc 100 for enabling selection of the desired anticipation heat. The electrical circuit (not shown) for energizing wire 102 so as to provide the desired anticipation heat is completed through an electrically-conductive arm 116 secured between coined end 26 of pin 16 and casing 12.

As shown in FIG. 3, the combined stack height of co-axially mounted switch means 32 and 34 is less than the distance between enlarged diameter portion 28 of pin 16 and washer 98 adjacent end 18 of pin 16. Also, as previously described, the diameters of the inner bores 54 and 84 of bushings 52 and 82, respectively, are slightly greater than the diameter of pin 16. As a result, there is essentially no friction forces between pin 16 and bushings 52 and 82.

Figure 4:
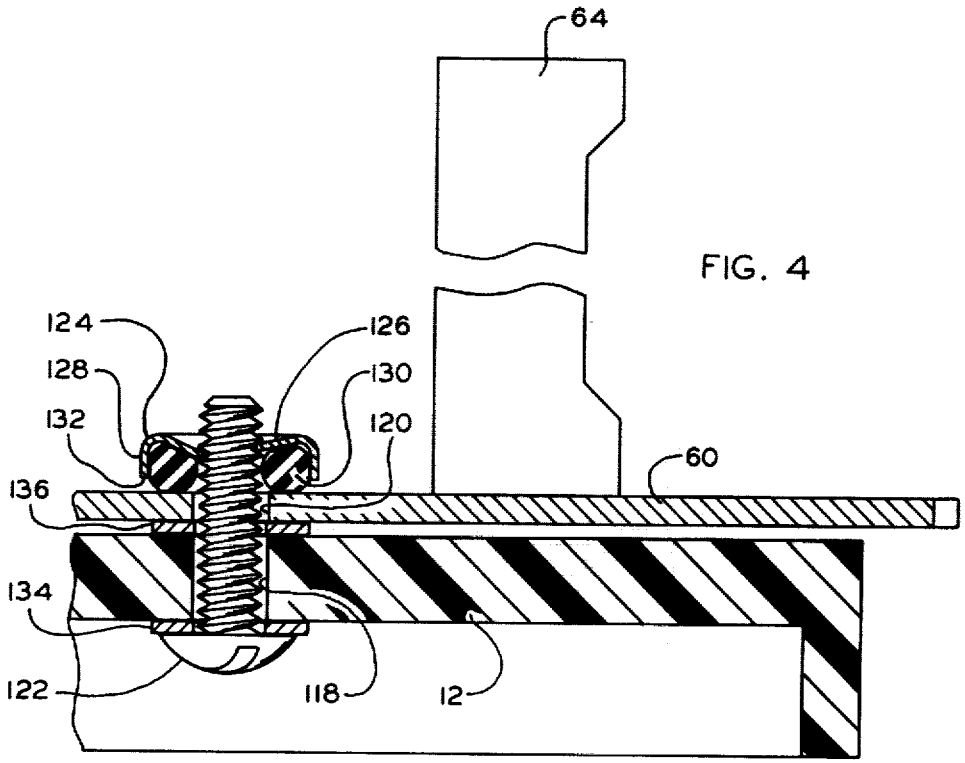
FIG. 4 is an enlarged cross-sectional view taken along line 4—4 of FIG. 1, showing the relative position of the parts in the force producing means when adjusted to normal force requirements for facilitating manual movement of the temperature set-point control lever.

Shown in FIG. 4 is a preferred construction of a force producing means for establishing a desired holding force on control lever 60 to ensure that control lever 60 will be stable at a desired temperature set-point position and also to enable manual movement of control lever 60 to a different set-point position when a desired force is applied to the end 62 of control lever 60. Although the force producing means is described in connection with control lever 60, it is to be understood that the description also applies to the force producing means for control lever 90.

As shown in FIG. 1, thermostat casing 12 is provided with an arcuate slot 118 constructed from pin 16 as the center point and located between pin 16 and peripheral edge 63 of casing 12. The length of slot 118 is sufficient to permit the desired amount of arcuate movement of control levers 60 and 90.

As shown in FIG. 4, arcuate slot 118 underlies an opening 120 in control lever 60. A screw 122 extends from the underside of casing 12, through arcuate slot 118 of casing 12 and opening 120 in control lever 60, and is threaded to a hollow, thin-walled, hexagonal nut 124, available commercially under the tradename "PALNUT", having a screw accepting base 126 for threadedly engaging screw 122 and an outer wall 128 extending downwardly from base 126 as viewed in FIG. 4.

Disposed within nut 124 is a torus or anchor ring 130 made of any suitable compressible elastic material such as rubber. The cross-section of ring 130 is such that ring 130, in its uncompressed state, is contiguous with base 126 and portions of wall 128 of nut 124, and extends downwardly slightly beyond a bottom edge 132 of wall 128.

Screw 122 also passes through a nylon washer 134 located adjacent the underside of casing 12 and a nylon washer 136 located adjacent the top side casing 12. The force required to manually move control lever 60 is determined by the values of the sliding friction forces between nylon washer 134 and the underside of casing 12 and between nylon washer 136 and the top side of casing 12. It is to be understood that, without nylon washers 134 and 136, the friction forces could be greater and also erratic due to burrs that could exist on the underside of the head of screw 122, on control lever 60, and on casing 12.

When screw 122 is threaded to nut 124 sufficiently so that ring 130, control lever 60, washer 136, casing 12, washer 134, and the underside of the head of screw 122 are clamped in intimate contact, further tightening of screw 122 causes ring 130 to be compressed. As ring 130 is compressed, it exerts more clamping force, the rate at which the clamping force increases being dependent upon the rate of change of the compressible ring 130. As the clamping force increases, the above described sliding friction forces also increase. Screw 122 is threaded to nut 124, causing compression of ring 130, until the sliding friction forces result in the value of force that is desired to be applied at the end 62 of control lever 60 to manually move control lever 60.

As ring 130 is compressed, it is distorted and partially fills voids within nut 124. Because it is confined within nut 124 by wall 128 of nut 124, ring 130 does not flow radially outwardly pass wall 128. Some advantages of this confinement are to avoid damaging ring 130, such as by pinching, to provide a wider range of adjustment of the clamping force, and to enable a preferred locked condition, as will now be described.

Figure 5:
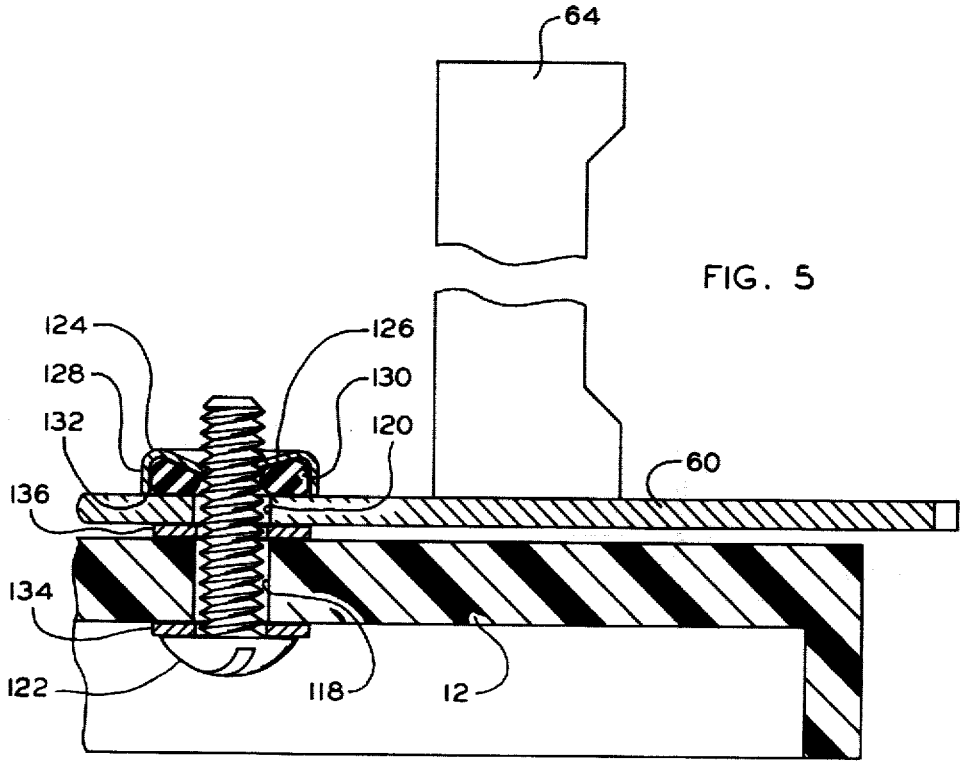
FIG. 5 is an enlarged cross-sectional view of the force producing means showing the relative position of the parts therein when the control lever is in a locked condition.

If screw 122 is further threaded to nut 124 until the bottom edge 132 of nut 124 contacts the top side of lever 60, as shown in FIG. 5, control lever and casing 12 are clamped together with sufficient force, due to the higher clamping force of nut 124 as compared to that of compressible ring 130, so that the above described sliding friction forces become sufficiently great to prevent manual movement of control lever 60. Control lever 60 is then in a so-called locked condition, a feature desired on some thermostats to prevent unauthorized changing of the temperature set-point.

It is noted that this locked condition could be achieved by constructing ring 130 with such force rate of change characteristics that it would exert sufficient clamping force before edge 132 of nut 124 contacts the top side of control lever 60. However, the illustrated construction is preferred because it provides a positive indication of when control lever 60 is in the locked condition. Even when thermostat 10 is not to be factory adjusted to the locked condition, the illustrated positive locked condition construction is advantageous in that it simplifies factory adjustment of the clamping force to the desired value for enabling manual movement of control lever 60. Specifically, the desired clamping force can usually be obtained by tightening screw 122 to the locked condition and then loosening screw 122 a predetermined amount.

While a preferred embodiment of the present invention has been illustrated and described in detail in the drawings and foregoing description, it will be recognized that many changes and modifications will occur to those skilled in the art. For example, the relative locations of screw 122 and the fastening means comprising nut 124 and ring 130 could be reversed. Also, the function of nut 124 could be provided by various other rigid members that are threaded and sufficiently concave with respect to ring 130 so as to confine ring 130 and provide intimate contact with lever 60 when in the locked condition. Also, while ring 130 is preferred, it should be noted that various other shapes of compressible means could be employed. It is therefore intended, by the appended claims, to cover any such changes and modifications as fall within the true spirit and scope of the invention.

I claim:

1. In a space thermostat having a manually movable temperature set-point control lever, an improved means for producing an adjustable holding force on the lever, which holding force determines the amount of force which must be applied to the lever to effect manual movement thereof, wherein the improvement comprises:

a thermostat casing having an elongated slot underlying the lever;

a screw extending through said slot and through an opening in said lever;

a hollow, rigid, thin-walled nut having a recess therein defined by a base for threadedly engaging said screw and an outer wall extending away from said base;

a compressible anchor ring radially confined in said recess by said outer wall and axially extending, when in an uncompressed state, beyond an edge of said outer wall; and means cooperative with opposed sides of said casing and through which said screw extends for determining the value of a sliding friction force between said lever and said casing, said ring being compressible in response to threading of said screw to said nut an amount causing said ring to axially extend a lesser amount beyond said edge of said outer wall than when in said uncompressed state and to remain radially confined in said recess for producing a clamping force between said lever and said casing and a resulting sliding friction force therebetween sufficient to render said lever stable in a set-point position and manually movable, upon application of a sufficient force thereto, to a different set-point position, said ring being further compressible to a locked position in response to further threading of said screw to said nut wherein said ring no longer axially extends beyond said edge of said outer wall, and a force clamping said lever and said casing together is exerted by said nut and results in a sliding friction force between said lever and said casing which is sufficiently great to prevent manual movement of said lever.

* * * * *